US010758958B2

(12) United States Patent
Tsukamoto et al.

(10) Patent No.: US 10,758,958 B2
(45) Date of Patent: Sep. 1, 2020

(54) ROLLER HEMMING PROCESSING METHOD AND ROLLER HEMMING PROCESSING DEVICE

(71) Applicants: TOYOTA JIDOSHA KABUSHIKI KAISHA, Toyota-shi, Aichi-ken (JP); Takatsu MFG. Co., Ltd., Minato-ku, Nagoya (JP)

(72) Inventors: Jiro Tsukamoto, Nissin (JP); Tamito Matsui, Toyota (JP); Yuichi Yamashita, Nissin (JP); Tsukasa Kume, Miyoshi (JP); Kazumoto Suzuki, Nagoya (JP); Atsushi Mizutani, Tsushima (JP)

(73) Assignees: TOYOTA JIDOSHA KABUSHIKI KAISHA, Toyota-shi, Aichi-ken (JP); Takatsu MFG. Co., Ltd., Minato-ku, Nagoya (JP)

( * ) Notice: Subject to any disclaimer, the term of this patent is extended or adjusted under 35 U.S.C. 154(b) by 144 days.

(21) Appl. No.: 16/158,409

(22) Filed: Oct. 12, 2018

(65) Prior Publication Data

US 2019/0111462 A1 Apr. 18, 2019

(30) Foreign Application Priority Data

Oct. 16, 2017 (JP) ..... 2017-200225

(51) Int. Cl.
*B21D 19/04* (2006.01)
*B21D 39/02* (2006.01)
(Continued)

(52) U.S. Cl.
CPC ..... *B21D 19/043* (2013.01); *B21D 37/145* (2013.01); *B21D 39/023* (2013.01); *B21D 43/003* (2013.01); *B21D 43/08* (2013.01)

(58) Field of Classification Search
CPC ..... Y10T 29/53678; Y10T 29/53791; B23P 19/047; B23P 2700/50; B25B 27/0035;
(Continued)

(56) References Cited

U.S. PATENT DOCUMENTS 5,224,253 A * 7/1993 Sawa ..... B21D 39/021 29/243.5
5,228,190 A * 7/1993 Sawa ..... B21D 39/021 29/243.57
(Continued)

FOREIGN PATENT DOCUMENTS

JP 03-081025 A 4/1991
JP 09-234527 A 9/1997
(Continued)

*Primary Examiner* — Tyrone V Hall, Jr.
(74) *Attorney, Agent, or Firm* — Sughrue Mion, PLLC

(57) ABSTRACT

A roller hemming processing device that has first to fifth processing surfaces and that rolls the respective processing surfaces while pressing the respective processing surfaces against a hemming flange in such a posture that an axis of a roller is parallel to an outer panel is used. A pre-processed portion obtained by bending the hemming flange to form a right angle with an inner flange is molded by using the third, fifth and fourth processing surfaces in a stepwise manner such that the angle of inclination with respect to the axis decreases. The pre-processed portion is inclined toward an inner panel side by using the second processing surface. An inclined wall portion that is inclined to contact the inner panel, and a hem portion that is in close contact with the inner panel are molded by simultaneously using the first and second processing surfaces.

7 Claims, 9 Drawing Sheets

(51) Int. Cl.
*B21D 37/14* (2006.01)
*B21D 43/08* (2006.01)
*B21D 43/00* (2006.01)

(58) Field of Classification Search
CPC .. B25B 27/0092; B21D 19/04; B21D 19/043; B21D 19/02; B21D 39/02; B21D 39/021; B21D 39/023; B21D 43/08; B21D 43/09
See application file for complete search history.

(56) References Cited

U.S. PATENT DOCUMENTS

| | | | | |
|---|---|---|---|---|
| 8,024,950 | B2 * | 9/2011 | Harrow | B21D 19/043<br>29/243.57 |
| 2003/0209048 | A1 * | 11/2003 | Friedman | B21D 39/021<br>72/220 |
| 2005/0262912 | A1 * | 12/2005 | Toeniskoetter | B21D 39/023<br>72/220 |

FOREIGN PATENT DOCUMENTS

| | | | |
|---|---|---|---|
| JP | 2007-229723 | A | 9/2007 |
| JP | 2011-041972 | A | 3/2011 |

* cited by examiner

ROLLER HEMMING PROCESSING METHOD AND ROLLER HEMMING PROCESSING DEVICE

INCORPORATION BY REFERENCE

The disclosure of Japanese Patent Application No. 2017-200225 filed on Oct. 16, 2017 including the specification, drawings and abstract is incorporated herein by reference in its entirety.

BACKGROUND

1. Technical Field

The disclosure relates to a roller hemming processing method and a roller hemming processing device for use in this method.

2. Description of Related Art

Hemming processing is carried out by folding back an edge portion of a panel by 180°, with a view to increasing the strength of the edge portion of the panel and ensuring safety in the case, for example, where someone's hand touches the edge portion of the panel. This hemming processing encompasses press hemming processing for bending the edge portion of the panel by means of press processing through the use of a hemming die (a hemming blade) or the like, and roller hemming processing for bending the edge portion of the panel by means of a roller.

This hemming processing is also used to perform so-called hemming coupling. In hemming coupling, for example, an outer panel having a flange (a hemming flange) provided at an edge portion thereof and an inner panel are stacked on each other, the hemming flange is folded back by 90°, and an edge portion of the inner panel is sandwiched between the outer panel and the folded-back hemming flange to couple the outer panel and the inner panel to each other.

It should be noted herein that the hemming flange of the outer panel may simply be folded back by 90° to be brought into close contact with the inner panel in the case where the edge portion of the inner panel is flat. It is therefore easy to perform hemming coupling between the outer panel and the inner panel. On the contrary, in the case, for example, where a flange (an inner flange) is provided on the inner panel, a space enveloping the inner flange must also be formed in addition to the need to bring a leading end portion of the folded-back hemming flange into close contact with the inner panel. Accordingly, it may not be easy to perform hemming coupling between the outer panel and the inner panel.

Thus, for example, in Japanese Patent Application Publication No. 3-81025 (JP 3-81025 A), there is disclosed a press hemming processing method including a pre-hemming process and a hemming process. In the pre-hemming process, a leading end portion of a hemming flange is folded back toward an inner panel side at a right angle to form a seating flange portion, with an inner flange serving as a core bar, through the use of a pre-hemming die. In the hemming process, the seating flange portion is further folded back toward the inner panel side to bring a leading end portion of the seating flange portion into close contact with the inner panel, and at the same time, to form a terminal portion of a hollow, closed cross-sectional structure, with the inner flange serving as a core bar, through the use of a hemming die.

SUMMARY

According to the press hemming processing method of the aforementioned Japanese Patent Application Publication No. 3-81025 (JP 3-81025 A), even in the case where the inner flange is provided at the edge portion of the inner panel, hemming coupling can be performed between the outer panel and the inner panel. In general, however, press hemming processing requires a relatively expensive hydraulic press molding device and a processing device as a dedicated facility. In other words, a new processing device must be prepared every time the shapes of the panels to be processed become different. Accordingly, the cost of processing may increase.

Thus, it is conceivable to carry out hemming coupling through the use of roller hemming processing even in the case where the inner flange is provided at the edge portion of the inner panel. However, the application of roller hemming processing to this case entails the following possibilities.

That is, in roller hemming processing, as shown in FIG. 10A, it is common to perform hemming coupling between an outer panel 150 and an inner panel 160 by rolling a processing surface 114 parallel to an axis SL of a roller 110 while pressing this processing surface against a hemming flange 151, which is bent into the shape of a hook (folded back by 180°), after inserting an edge portion of the inner panel 160 into the hemming flange 151 as indicated by a blank arrow. However, when the outer panel and the inner panel assume a certain shape, it may be difficult to insert the edge portion of the inner panel into the hemming flange bent into the shape of a hook. In this case, the hemming flange must be subjected to hemming processing in such a manner as to form a large angle from a state where there is no trigger for bending. As a result, processing may become difficult.

Besides, even in the case where a state where an inner flange 161 is inserted in the hemming flange 151 bent into the shape of a hook can be created, when an attempt is made to bend the hemming flange 151 in such a manner as to envelop the inner flange 161 by the processing surface 114 parallel to the axis SL of the roller 110, the processing surface 114 must be diagonally pressed against the hemming flange 151 folded back toward the inner flange 161 side at a right angle, as shown in FIG. 10B. That is, the roller 110 must be pressed against the hemming flange 151 folded back toward the inner flange 161 side at a right angle, with the axis SL of the roller 110 inclined with respect to the outer panel 150. Accordingly, there is also a possibility of interference between a receiving pedestal 125 for the panels and the roller 110.

Furthermore, as shown in FIG. 10C, when an attempt is made to process the hemming flange 151 folded back toward the inner flange 161 side at a right angle just once through the pressing and rolling of the processing surface, a leading end of the hemming flange 151 and the inner panel 160 interfere with each other, so it becomes difficult to mold a hem portion as a leading end portion that is in close contact with the inner panel 160.

The disclosure provides an art for realizing hemming coupling between one panel and the other panel by bending a flange provided at an edge portion of one panel in such a manner as to envelop a flange provided at an edge portion of the other panel even from a state where there is no trigger for bending, while reducing the cost of processing.

In a roller hemming processing method according to the disclosure and a roller hemming processing device according to the disclosure, a plurality of processing surfaces that are different from one another in angle of inclination and direction of inclination with respect to an axis of a roller are selectively used in accordance with the stage of processing.

In a roller hemming processing method according to one aspect of the disclosure, a first flange provided at an edge portion of a first panel is bent in such a manner as to envelop a second flange provided at an edge portion of a second panel stacked on the first panel and having a shorter length than the first flange, by rolling processing surfaces of a roller portion pressed against the first flange along the first flange, through the use of a roller that is constituted of the roller portion and a shaft portion parallel to an axis of the roller.

This roller hemming processing method has first to fourth processes. As the first process, a roller hemming processing device that has a plurality of processing surfaces including at least a first processing surface parallel to the axis of the roller, a second processing surface that is inclined from the first processing surface toward a side of the shaft portion at a predetermined angle with respect to the axis of the roller, and two or more tapered processing surfaces that are inclined toward a leading end side of the roller at different angles with respect to the axis of the roller respectively, and that rolls the respective processing surfaces while pressing the respective processing surfaces against the first flange in such a posture that the axis of the roller is parallel to the first panel is prepared, and the second panel is fixed to the first panel stacked on the second panel such that the first flange and the second flange overlap with each other. As the second process, a plurality of selected processing surfaces other than the second processing surface are pressed against a region of the first flange that protrudes from the second flange in a stepwise manner such that an angle of inclination with respect to the axis of the roller decreases, and a pre-processed portion that is obtained by bending this region toward a side of the second flange in such a manner as to form a right angle with the second flange is molded. As the third process, the second processing surface is pressed against the pre-processed portion, and the pre-processed portion is inclined toward a side of the second panel within such a range as not to come into contact with the second panel. As the fourth process, the first processing surface and the second processing surface are simultaneously pressed against the inclined pre-processed portion, and the inclined pre-processed portion is molded into an inclined wall portion that is inclined at the predetermined angle and that has a leading end abutting on the second panel, and a hem portion that extends from a leading end portion of the inclined wall portion and that is in close contact with the second panel.

Incidentally, in the disclosure, "the first (or the second) flange provided at the edge portion of the first (or the second) panel" means a flange that extends from the edge portion of the panel perpendicularly to the panel.

Besides, as for "the plurality of the processing surfaces", only the first processing surface and the second processing surface may be required to correspond to the axis of the roller (formed at a common roller portion), whereas the other processing surfaces may correspond to the axis of the roller that is common to the first processing surface and the second processing surface (formed on the common roller) or correspond to axes of different rollers (formed on different rollers).

Furthermore, as long as "the plurality of the processing surfaces" include at least the first processing surface, the second processing surface and the two or more tapered processing surfaces, they may further include, for example, one or more processing surfaces parallel to the axis of the roller, such as the first processing surface.

Based on these premises, according to the disclosure, the pre-processed portion is molded by using a plurality of the selected processing surfaces other than the second processing surface in a stepwise manner such that the angle of inclination with respect to the axis of the roller decreases. More specifically, the tapered processing surface (provisionally referred to as a first tapered processing surface) that is inclined toward the leading end side of the roller at, for example, 60° with respect to the axis of the roller, the tapered processing surface (provisionally referred to as a second tapered processing surface) that is inclined toward the leading end side of the roller at, for example, 30° with respect to the axis of the roller, and the processing surface (provisionally referred to as a flat processing surface) that is parallel to the axis of the roller are selected from the processing surfaces other than the second processing surface. Then, when the first tapered processing surface that is inclined at the larger angle with respect to the axis of the roller is rolled while being pressed against the region of the first flange that protrudes from the second flange in such a posture that the axis of the roller is parallel to the first panel, this region is inclined toward the side of the second flange by 30° while the second flange overlapping with the first flange serves as a core bar.

Subsequently, when the second tapered processing surface is rolled while being pressed against the region of the first flange inclined by 30° in such a posture that the axis of the roller is parallel to the first panel, this region is inclined toward the side of the second flange by 60° with the second flange serving as a core bar. Furthermore, when the flat processing surface parallel to the axis of the roller (inclined at an angle of 0°) is rolled while being pressed against the region of the first flange inclined by 60° in such a posture that the axis of the roller is parallel to the first panel, the pre-processed portion bent toward the side of the second flange in such a manner as to form a right angle with the second flange is molded with the second flange serving as a core bar. Incidentally, the flat processing surface may be the first processing surface.

As described hitherto, according to the disclosure, the first flange provided at the edge portion of the first panel can be bent into the shape of a hook from a state where there is no trigger for bending, even when no pre-hemming die as in the case of press hemming processing is used. Moreover, the pre-processed portion is molded through the use of two or more tapered processing surfaces, in other words, in three or more stages. Thus, a strain can be restrained from being generated when the bending amount in each bending cycle is large.

By the way, when the second processing surface is pressed at once against the pre-processed portion thus molded by a large pressing amount, the leading end of the inclined pre-processed portion comes into contact with the second panel in addition to the generation of a strain. As a result, it may become difficult to mold the hem portion.

Thus, in the disclosure, the pre-processed portion is inclined toward the side of the second panel within such a range as not to come into contact with the second panel, by pressing the second processing surface against the pre-processed portion. When the second processing surface is rolled while being pressed against the pre-processed portion, the pre-processed portion is inclined such that the leading end thereof approaches the second panel, with the second flange serving as a core bar.

Subsequently, when the first processing surface and the second processing surface are rolled while being simultaneously pressed against the inclined pre-processed portion, the inclined wall portion that is inclined at the predetermined angle and that has the leading end in contact with the second panel is molded by the second processing surface, with the second flange serving as a core bar. At the same time, the leading end portion of the inclined pre-processed portion is sandwiched between the second panel and the first processing surface and is molded into the hem portion that is in close contact with the second panel.

As described above, according to the disclosure, hemming coupling can be performed between the first panel and the second panel by bending the first flange erected on the first panel in such a manner as to envelop the second flange erected on the second panel, even from the state where there is no trigger for bending.

Moreover, there is no need for any relatively expensive hydraulic press molding device, and even panels of different shapes can be subjected to hemming processing through the use of a common roller, simply by replacing a jig or the like for fixing the panels. Therefore, the cost of processing can be made lower than in the case of press hemming processing that requires a processing device as a dedicated facility.

Furthermore, the inclined wall portion can be molded while maintaining such a posture that the axis of the roller is parallel to the first panel, through the use of the second processing surface that narrows toward the side of the shaft portion. Therefore, the receiving pedestal for the panels and the roller can be restrained from interfering with each other.

Besides, in the aforementioned roller hemming processing method, a first pressing amount by which the second processing surface is pressed against the pre-processed portion in the third process may be smaller than a second pressing amount by which the first processing surface and the second processing surface are pressed against the inclined pre-processed portion in the fourth process.

According to this configuration, a strain can be restrained from being generated in the case where the bending amount in each bending cycle is large, and the leading end of the inclined pre-processed portion can be easily restrained from coming into contact with the second panel, by setting the first pressing amount as a relatively small pressing amount. Furthermore, the inclined wall portion inclined at the predetermined angle and the hem portion that is in close contact with the second panel can be easily molded with a simple configuration where the first processing surface and the second processing surface are simultaneously pressed by the second pressing amount that is larger than the first pressing amount.

Besides, in the aforementioned roller hemming processing method, the first panel may be an outer panel of a vehicular sun roof in which an opening portion is formed, the second panel may be an inner panel of the vehicular sun roof, and the first flange and the second flange may be erected at edge portions that define the opening portion, respectively.

In the vehicular sun roof, the first flange is often cylindrically erected along the entire circumference of the edge portion that defines the opening portion of the outer panel, and the second flange is often cylindrically erected along the entire circumference of the edge portion that defines the opening portion of the inner panel. Therefore, it is safe to conclude that the outer panel and the inner panel in the vehicular sun roof constitute a typical example in which it is difficult to insert the second flange into the first flange bent into the shape of a hook, because there is no alternative but to insert the cylindrical first flange into the cylindrical second flange from a cylinder axis direction in stacking both the panels on each other. Therefore, the roller hemming processing method according to the disclosure can be used in the case where hemming coupling is performed between the outer and inner panels of the vehicular sun roof.

Besides, a roller hemming processing device according to another aspect of the disclosure envelops a second flange provided at an edge portion of a second panel stacked on a first panel and having a shorter length than a first flange erected at an edge portion of the first panel, by rolling processing surfaces of a roller portion pressed against the first flange along the first flange.

This roller hemming processing device is equipped with a fixing portion, a roller, and a moving portion. The fixing portion fixes the second panel to the first panel stacked on the second panel such that the first flange and the second flange overlap with each other. The roller is constituted of the roller portion and a shaft portion parallel to an axis of the roller, and has a plurality of processing surfaces including at least a first processing surface parallel to the axis of the roller, a second processing surface that is inclined from the first processing surface toward the side of the shaft portion at a predetermined angle with respect to the axis of the roller, and two or more tapered processing surfaces that are inclined toward a leading end side of the roller at different angles with respect to the axis of the roller respectively, as the processing surfaces. The moving portion selects a processing surface for use from the plurality of the processing surfaces, and moves the roller while pressing the selected processing surface against the first flange in such a posture that the axis of the roller is parallel to the first panel.

Then, the moving portion is characterized by being configured to (A) press a plurality of selected processing surfaces other than the second processing surface against a region of the first flange that protrudes from the second flange in a stepwise manner such that an angle of inclination with respect to the axis of the roller decreases, in molding a pre-processed portion that is obtained by bending the region toward the side of the second flange in such a manner as to form a right angle with the second flange, (B) press the second processing surface against the pre-processed portion, in inclining the pre-processed portion toward the side of the second panel within such a range as not to come into contact with the second panel, and (C) simultaneously press the first processing surface and the second processing surface against the inclined pre-processed portion, in molding the inclined pre-processed portion into an inclined wall portion that is inclined at the predetermined angle and that has a leading end abutting on the second panel, and a hem portion that extends from a leading end portion of the inclined wall portion and that is in close contact with the second panel.

In the same manner as described above about the roller hemming processing method, this roller hemming processing device makes it possible to perform hemming coupling between the first panel and the second panel by bending the first flange erected on the first panel in such a manner as to envelop the second flange erected on the second panel even from the state where there is no trigger for bending, while reducing the cost of processing.

Besides, in the aforementioned roller hemming processing device, a first pressing amount by which the second processing surface is pressed against the pre-processed portion in inclining the pre-processed portion toward the side of the second panel may be set smaller than a second pressing amount by which the first processing surface and the second processing surface are pressed against the inclined pre-processed portion in molding the inclined pre-processed portion into the inclined wall portion and the hem portion.

In the same manner as described above about the roller hemming processing method, this configuration makes it possible to restrain a strain from being generated when the bending amount in each bending cycle is large, easily restrain the leading end of the inclined pre-processed portion from coming into contact with the second panel, and easily mold the inclined wall portion and the hem portion with a simple configuration.

Besides, in the aforementioned roller hemming processing device, the fixing portion may have a guide portion that binds a region of the first flange that overlaps with the second flange from an opposite side of the second flange, and the moving portion may be configured to move the roller while holding the roller in contact with the guide portion in molding the pre-processed portion.

According to this configuration, the region of the first flange that overlaps with the second flange is bound by the guide portion from the opposite side of the second flange. Thus, the first flange can be restrained from swelling toward the opposite side of the second flange in bending the region of the first flange that protrudes from the second flange with a view to molding the pre-processed portion.

Besides, in the case where the pre-processed portion is molded, the roller is moved (the processing surface is rolled) while being held in contact with this guide portion. Thus, the first flange can be accurately bent even from the state where there is no trigger for bending.

Furthermore, in the aforementioned roller hemming processing device, the roller may have a first roller portion provided on one side of the shaft portion, and a second roller portion provided on the other side of the shaft portion. The first processing surface, the second processing surface, and a third processing surface as one of the tapered processing surfaces, which is inclined from the first processing surface toward a leading end side at a first angle with respect to the axis of the roller, may be formed on the first roller portion, whereas a fourth processing surface parallel to the axis of the roller and a fifth processing surface as one of the tapered processing surfaces, which is inclined from the fourth processing surface toward the leading end side at a second angle with respect to the axis of the roller, may be formed on the second roller portion. The first angle may be set larger than the second angle.

According to this configuration, the two roller portions on which the plurality of the processing surfaces required for roller hemming processing are formed are provided on the single roller across the shaft portion. Thus, the highly versatile roller hemming processing device can be performed with a simple configuration in which the roller is inverted in accordance with the selected processing surface.

Moreover, the first angle is set larger than the second angle. In other words, the protrusion length of the third processing surface, which is inclined from the first processing surface toward the leading end side, from the first processing surface is relatively short. Thus, the third processing surface that protrudes from the first processing surface can be restrained from interfering with the fixing portion that supports the first panel and the second panel, in molding the inclined wall portion and the hem portion through the use of the first processing surface and the second processing surface.

As described above, the roller hemming processing method according to the disclosure and the roller hemming processing device according to the disclosure make it possible to perform hemming coupling between one panel and the other panel by bending a flange provided at an edge portion of one panel in such a manner as to envelop a flange provided at an edge portion of the other panel, even from a state where there is no trigger for bending, while reducing the cost of processing.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Modes for carrying out the disclosure will be described hereinafter based on the drawings.

Figure 1:
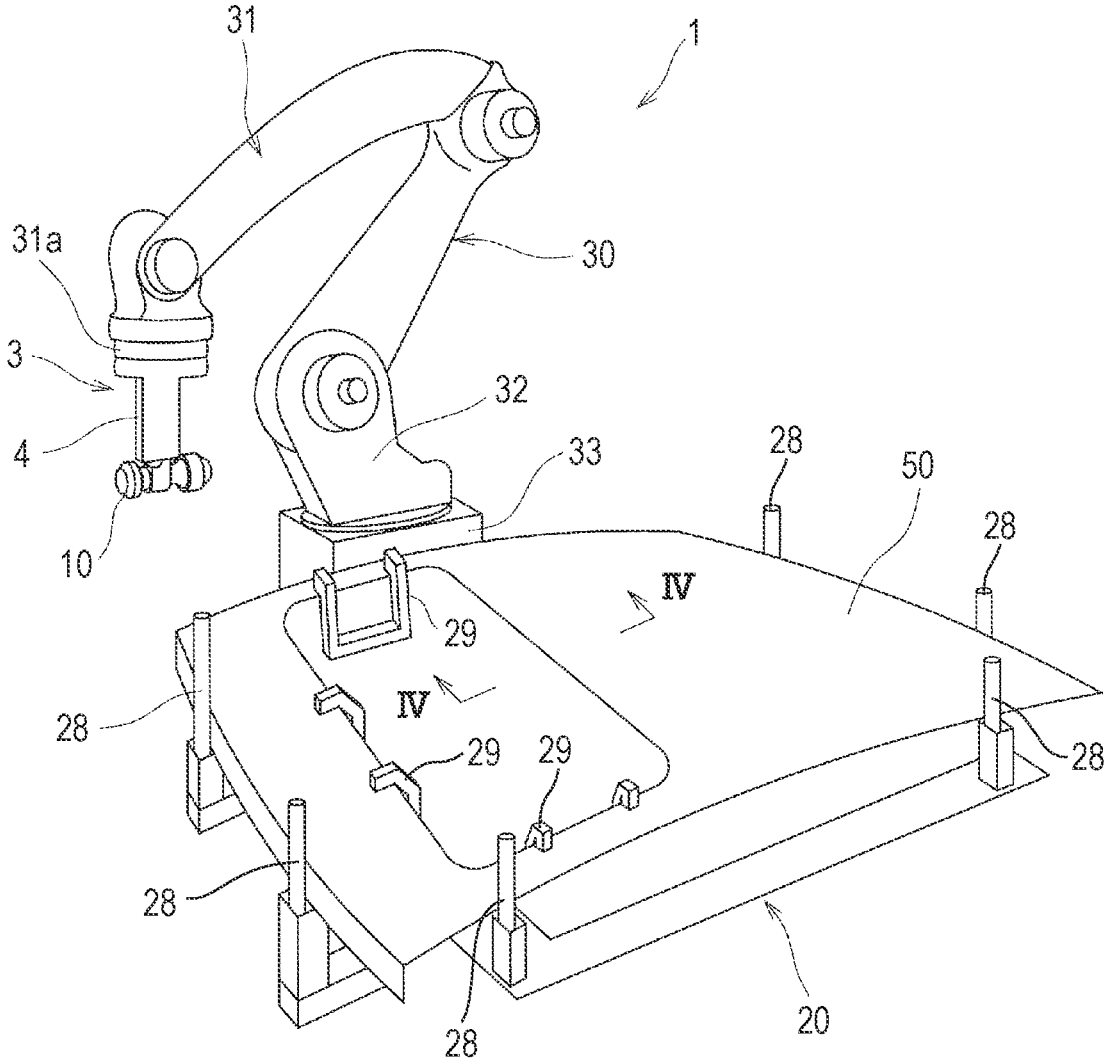
FIG. 1 is a perspective view schematically showing an essential part of a roller hemming processing device according to an embodiment of the disclosure.
Figure 2A:
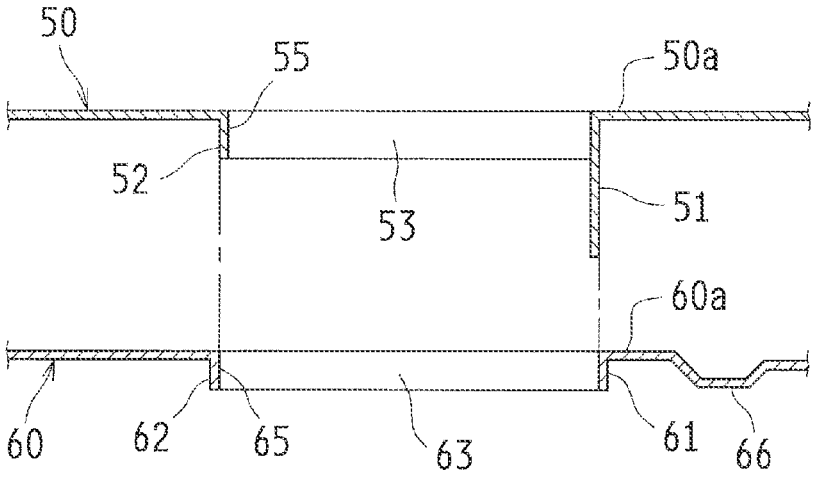
FIG. 2A is a cross-sectional view schematically showing an outer panel to be processed and an inner panel to be processed in a state before the start of processing.
Figure 2B:
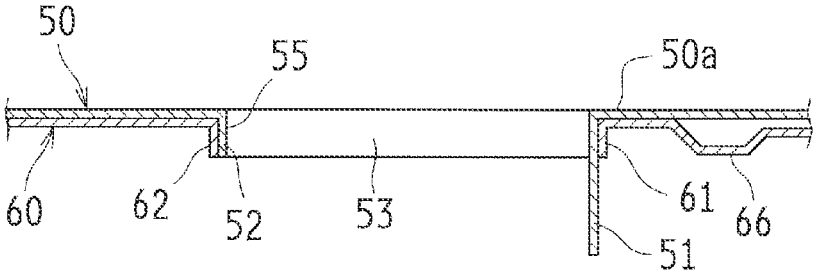
FIG. 2B is a cross-sectional view schematically showing the outer panel to be processed and the inner panel to be processed in a state where both the panels are stacked on each other.
Figure 2C:
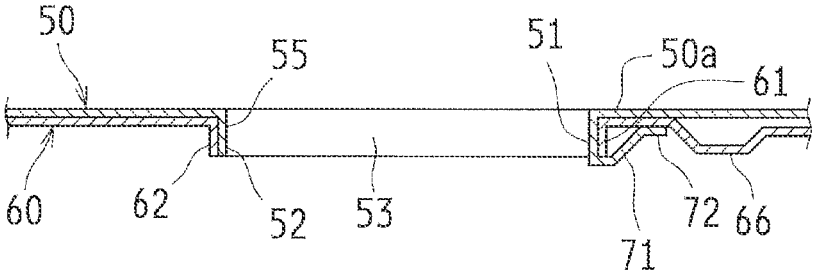
FIG. 2C is a cross-sectional view schematically showing the outer panel to be processed and the inner panel to be processed in a state after the completion of processing.

FIG. 1 is a perspective view schematically showing an essential part of a roller hemming processing device 1 according to an embodiment of the disclosure. Besides, each of FIGS. 2A, 2B and 2C is a cross-sectional view schematically showing an outer panel 50 to be processed and an inner panel 60 to be processed. FIG. 2A shows a state before the start of processing. FIG. 2B shows a state where both the panels are stacked on each other. FIG. 2C shows a state after the completion of processing. This roller hemming processing device 1 bends a hemming flange 51 provided at an edge portion of the outer panel 50 in such a manner as to envelop an inner flange 61 provided at an edge portion of the inner panel 60 stacked on the outer panel 50 as shown in FIG. 2C, by rolling processing surfaces of a roller 10 pressed against the hemming flange 51 along the hemming flange 51, and thus performs hemming coupling between the outer panel 50 and the inner panel 60.

—Outer Panel and Inner Panel—

Figure 3:
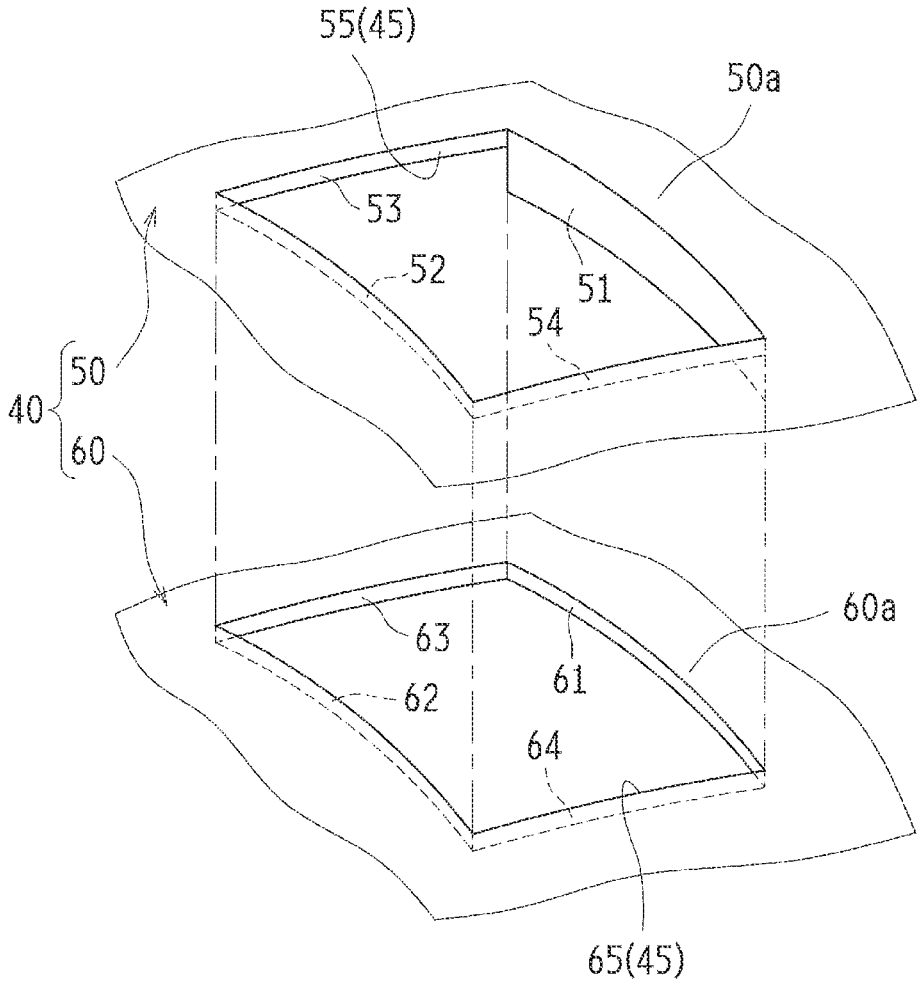
FIG. 3 is a perspective view schematically showing the outer panel and the inner panel.

FIG. 3 is a perspective view schematically showing the outer panel 50 and the inner panel 60. The outer panel (a first panel) 50 and the inner panel (a second panel) 60 constitute a vehicular sun roof 40 through which an opening portion 45 is formed.

Incidentally, for the sake of convenience, the following description will be given on the assumption that "a front side" is defined as a front side of the vehicular sun roof 40 in a vehicle longitudinal direction (a left side in FIGS. 2A to 2C), and that "a rear side" is defined as a rear side of the vehicular sun roof 40 in the vehicle longitudinal direction (a right side in FIGS. 2A to 2C).

Flanges 51, 52, 53 and 54 that extend downward substantially perpendicularly to the outer panel 50 are provided at edge portions that define an opening portion 55 of the outer panel 50, respectively, along an entire circumference thereof. These flanges 51, 52, 53 and 54 are connected at longitudinal end portions thereof to one another, thus assuming the shape of a rectangular cylinder. The hemming flange (a first flange) 51 is provided at an edge portion 50*a* that defines a rear end of the opening portion 55. The hemming flange 51 is formed longer than the other flanges 52, 53 and 54 and extends downward.

Flanges 61, 62, 63 and 64 that extend downward substantially perpendicularly to the inner panel 60 are provided at edge portions that define an opening portion 65 of the inner panel 60, respectively, along an entire circumference thereof. These flanges 61, 62, 63 and 64 are connected at longitudinal end portions thereof to one another, thus assuming the shape of a rectangular cylinder. The inner flange (a second flange) 61 is provided at an edge portion 60*a* that defines a rear end of the opening portion 65, and is formed shorter than the hemming flange 51 (see FIG. 2B). Incidentally, a reference symbol 66 in FIGS. 2A to 2C denotes a convex portion formed on the inner panel 60 as a design, which is not an indispensable configuration. However, a portion having such an irregular shape may be formed on the inner panel 60.

As described hitherto, the rectangular cylinder-like flanges are erected on both the outer panel 50 and the inner panel 60 respectively. Thus, in stacking the outer panel 50 and the inner panel 60 on each other, the outer panel 50 is stacked on the inner panel 60 in such a manner as to insert the rectangular cylinder-like flanges 51, 52, 53 and 54 into inner sides of the rectangular cylinder-like flanges 61, 62, 63 and 64 respectively as shown in FIG. 2B. Incidentally, hemming coupling is performed only between the hemming flange 51 and the inner flange 61. The flanges 52, 53 and 54 and the flanges 62, 63 and 64 are joined to each other respectively through spot welding, after the completion of hemming coupling.

—Roller Hemming Processing Device—

As shown in FIG. 1, the roller hemming processing device 1 is equipped with a fixing jig 20 that fixes the outer panel 50 and the inner panel 60, which are vertically stacked on each other, to each other, a roller mechanism 3 that has the roller 10 on which a plurality of processing surfaces are formed, and a hemming robot 30 having a robot arm 31 whose leading end has the roller mechanism 3 attached thereto. Incidentally, in FIG. 1, for the sake of visibility of the drawing, an upper die 21 and the like included by the fixing jig 20 is omitted.

⟨Fixing Jig⟩

As shown in FIG. 1, the fixing jig (the fixing portion) 20 is provided with a plurality of positioning pins 28 and a plurality of clamp units 29. The positioning pins 28 are arranged at positions along an outer periphery of the outer panel 50 respectively, and position the outer panel 50 and the inner panel 60 at an appropriate position. Besides, the clamp units 29 integrally pin down the outer panel 50 and the inner panel 60 and fix these panels to the fixing jig 20, at the edge portions that define front and lateral ends of the opening portion 55 of the outer panel 50, which are not subjected to hemming processing. Incidentally, the positioning pins 28 and the clamp units 29 are configured such that their positions can be changed, and are also applicable to sun roofs 40 of different types of vehicles.

Figure 4:
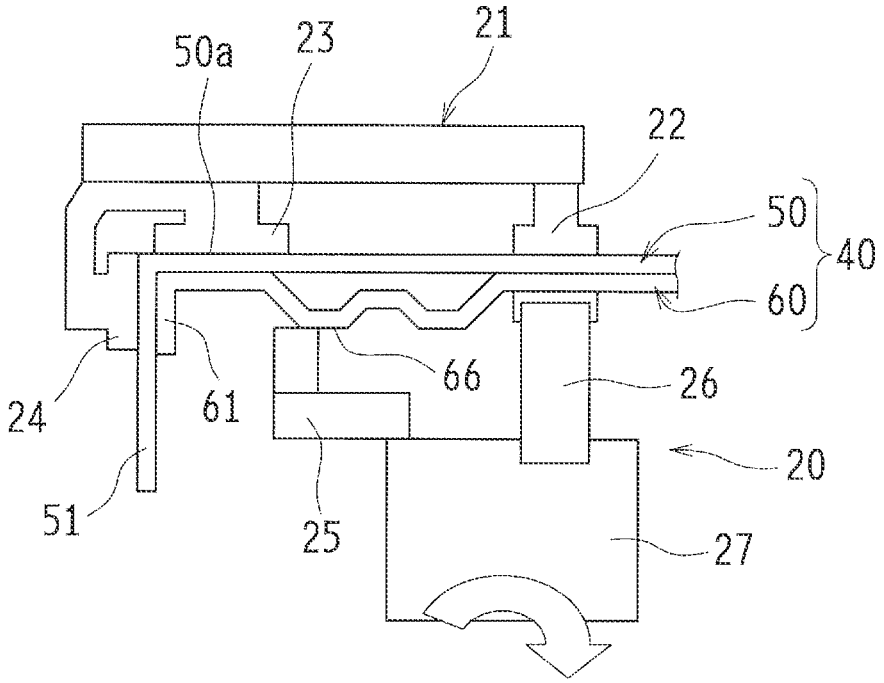
FIG. 4 is a cross-sectional view taken along a line IV-IV of FIG. 1 as viewed in the direction of arrows.

FIG. 4 is a cross-sectional view taken along a line IV-IV of FIG. 1 as viewed in the direction of arrows. Incidentally, in FIG. 4, for the sake of visibility of the drawing, hatching representing a cross-section is omitted. As shown in FIG. 4, the fixing jig 20 has a turning mechanism portion 27, first and second lower dies 25 and 26 that receive (support) the inner panel 60, and the upper die 21 that integrally pins down the outer panel 50 and the inner panel 60 between these first and second lower dies 25 and 26.

As indicated by a blank arrow in FIG. 4, the turning mechanism portion 27 is configured to turn clockwise (or counterclockwise) in FIG. 4 in accordance with a gradient of the sun roof 40. The first lower die 25 and the second lower die 26 are removably attached to the turning mechanism portion 27. Therefore, the fixing jig 20 is also applicable to sun roofs 40 of different types of vehicles by replacing the first lower die 25 and the second lower die 26 and turning the turning mechanism portion 27 in accordance with the shape of the inner panel 60. Incidentally, the turning mechanism portion 27 is not indispensable. The sun roofs 40 having different gradients may be coped with by preparing the first lower die 25 and the second lower die 26, which are different in dimension in a height direction from each other. Besides, in FIG. 4, the first lower die 25 is arranged in such a manner as to support a lower end of the convex portion 66. However, the first lower die 25 having the larger height dimension may be used in the case of application to the sun roof 40 with no convex portion 66.

On the other hand, the upper die 21 is arranged at an appropriate position by being placed with respect to a positioning pin (not shown) on the outer panel 50, which is supported by the first lower die 25 and the second lower die 26 via the inner panel 60. Arranged at the appropriate position, this upper die 21 has a pad 22 that fixes the outer panel 50 and the inner panel 60 while sandwiching these panels between the pad 22 and the second lower die 26, a hemming die 23 that presses the edge portion 50*a* of the outer panel 50 from above, and a guide portion 24 that binds a region of the hemming flange 51 that overlaps with the inner flange 61 from the opposite side of the inner flange 61. The upper die 21 is also applicable to sun roofs 40 of different types of vehicles by being replaced in accordance with the shape of the outer panel 50.

Incidentally, the first lower die 25, the second lower die 26 and the upper die 21 are configured to be easily replaceable through the robot arm 31 by engaging an engaging bracket (not shown) provided on the roller mechanism 3 with engaged portions (not shown) provided on this first lower die 25, this second lower die 26 and this upper die 21.

⟨Roller Mechanism⟩

Figure 5:
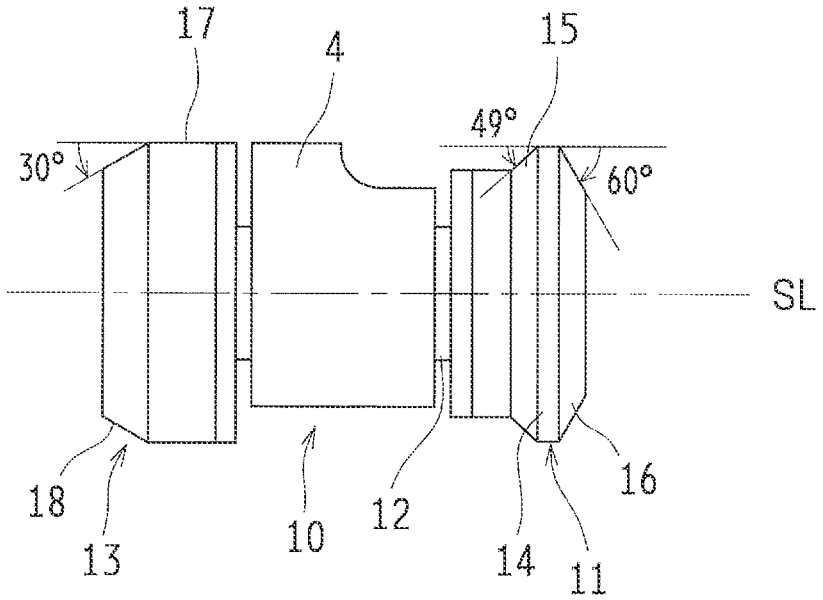
FIG. 5 is a view schematically showing a roller.

FIG. 5 is a view schematically showing the roller 10. The roller mechanism 3 has the roller 10, and a roller head 4 that rotatably supports a shaft portion 12 of the roller 10. The roller 10 has a first roller portion 11 provided on one side of the shaft portion 12, and a second roller portion 13 provided on the other side of the shaft portion 12.

As shown in FIG. 5, a first processing surface 14 as a circular cylinder surface parallel to an axis SL of the roller 10 (hereinafter also referred to simply as the axis SL), a second processing surface 15 as a tapered surface that is inclined at 49° (a predetermined angle) with respect to the axis SL in such a manner as to narrow from the first processing surface 14 toward a base end side (the shaft portion 12 side), and a third processing surface 16 as a tapered surface that is inclined at 60° (a first angle) with respect to the axis SL in such a manner as to narrow from the first processing surface 14 toward a leading end side are formed on the first roller portion 11.

On the other hand, as shown in FIG. 5, a fourth processing surface 17 as a circular cylinder surface parallel to the axis SL, and a fifth processing surface 18 as a tapered surface that is inclined at 30° (a second angle) with respect to the axis SL in such a manner as to narrow from the fourth processing surface 17 toward the leading end side are formed on the second roller portion 13.

The third processing surface 16 and the fifth processing surface 18 are formed such that a generatrix of the third processing surface 16 and a generatrix of the fifth processing surface 18 are equal in length to each other. However, an angle of inclination of the third processing surface 16 with respect to the axis SL is set larger than an angle of inclination of the fifth processing surface 18 with respect to the axis SL, so a protrusion length of the third processing surface 16 from the first processing surface 14 is shorter than a protrusion length of the fifth processing surface 18 from the fourth processing surface 17.

Incidentally, in relation to the claims, the third processing surface 16 and the fifth processing surface 18 are equivalent to "the two or more tapered processing surfaces that are inclined toward the leading end side of the roller at different angles with respect to the axis of the roller respectively".

⟨Hemming Robot⟩

The hemming robot (the moving portion) 30 is a multi-joint robot and is equipped with the robot arm 31 and a body base 32. The roller head 4 is connected to a leading end portion 31*a* of the robot arm 31 via a spring 35 (see FIGS. 6 and 7). Therefore, the roller head 4 is always urged toward the robot arm 31 side. The body base 32 is fixed to a robot pedestal 33 in a swingable manner. The leading end portion 31*a* of the robot arm 31 is rotatably configured and can freely change the direction of the roller 10 supported by the roller head 4.

This hemming robot 30 is taught to select a processing surface for use from the first processing surface 14, the second processing surface 15, the third processing surface 16, the fourth processing surface 17 and the fifth processing surface 18 in accordance with the processing stage, and move the roller 10 along the edge portion 50*a* while pressing the selected processing surface against the hemming flange 51 from below in such a posture that the axis SL of the roller 10 is substantially parallel to the outer panel 50.

Figure 6:
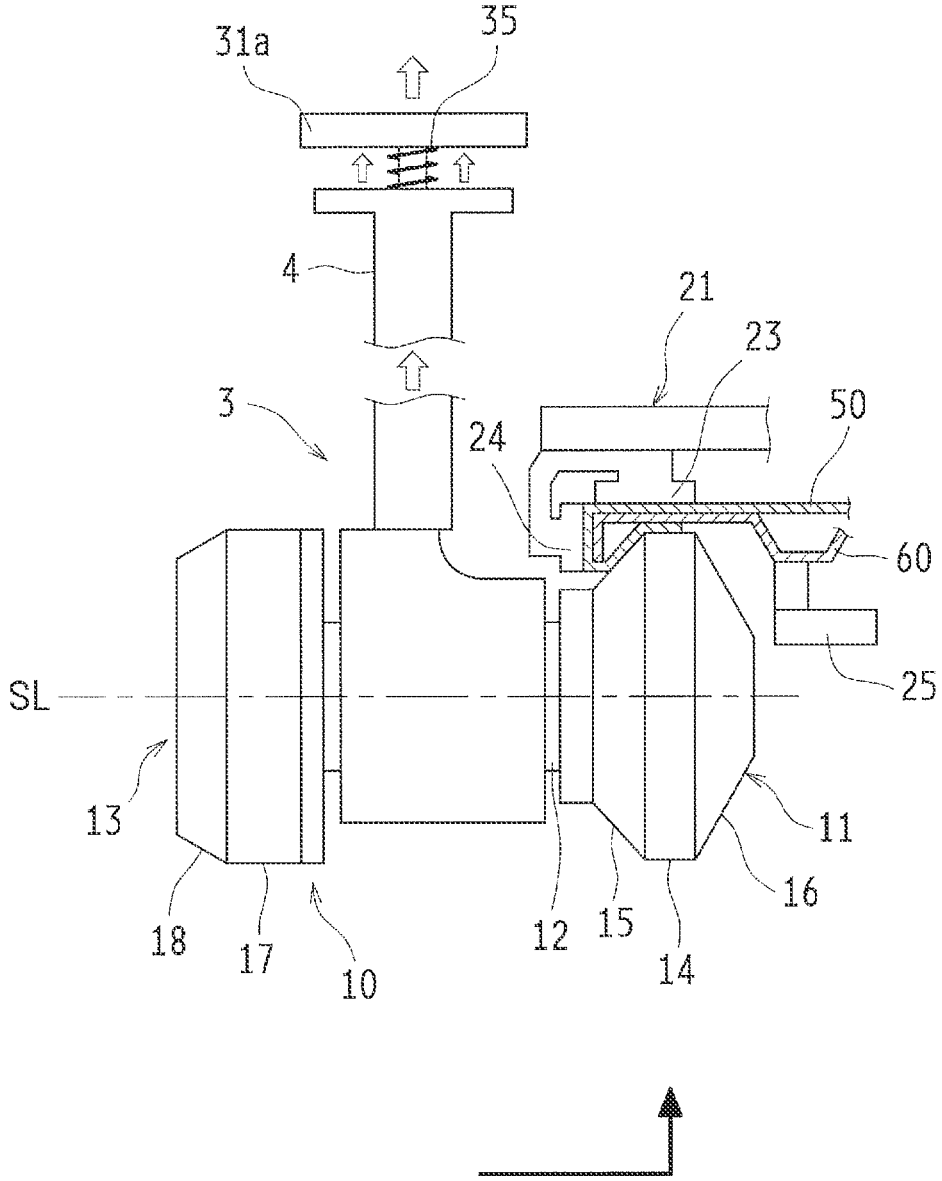
FIG. 6 is a view schematically illustrating a state of the roller at the time of processing.
Figure 7:
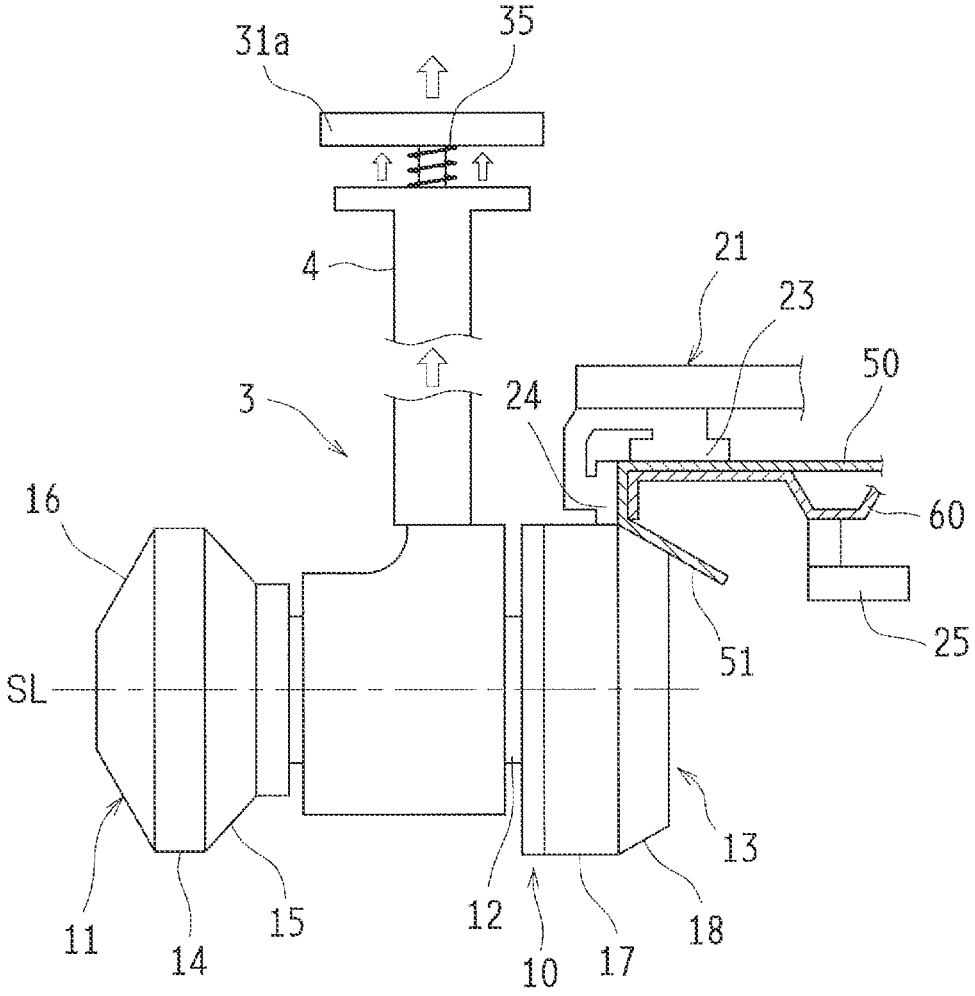
FIG. 7 is a view schematically illustrating the state of the roller at the time of processing.

Each of FIGS. 6 and 7 is a view schematically illustrating a state of the roller 10 at the timing of processing. In concrete terms, as indicated by a blackened arrow in FIG. 6, the hemming robot 30 is taught to move the roller 10 such that the selected processing surface is located directly below a location to be processed, and then draw up the robot arm 31 in such a posture that the axis SL of the roller 10 is substantially parallel to the outer panel 50. When the robot arm 31 is drawn up, the roller head 4 is pulled upward due to an urging force of the spring 35, and the selected processing surface is pressed against the location to be processed. Thus, with the aid of the urging force of the spring 35, even if an actual locus deviates from a teaching locus due to deflection of the robot arm 31, the backlash of respective joints of the hemming robot 30 or the like, the selected processing surface can be rolled along the teaching locus while being pressed against the location to be processed from below.

Besides, in the case where the actual locus is more reliably made to coincide with the teaching locus, the hemming robot 30 is taught to bring the fourth processing surface 17 (or the first processing surface 14) parallel to the axis SL of the roller 10 into contact with a lower end of the guide portion 24 of the upper die 21, as shown in FIG. 7. More specifically, the upper die 21 having the guide portion 24 whose lower end portion is formed in the shape corresponding to the teaching locus is prepared. Then, when the robot arm 31 is drawn up after moving the roller 10 such that the fourth processing surface 17 (or the first processing surface 14) is located directly below the guide portion 24, the roller head 4 is pulled upward due to the urging force of the spring 35, and the fourth processing surface 17 (or the first processing surface 14) comes into contact with the lower end of the guide portion 24. When the fourth processing surface 17 (or the first processing surface 14) thus comes into contact with the lower end of the guide portion 24, the roller 10 naturally assumes such a posture that the axis SL thereof is substantially parallel to the outer panel 50. In this state, the fifth processing surface 18 (or the third processing surface 16) can be rolled along the teaching locus by moving the roller 10 with the roller 10 held in contact with the guide portion 24, while maintaining such a posture that the axis SL is substantially parallel to the outer panel 50.

—Roller Hemming Processing Method—

By the way, as shown in the aforementioned FIG. 2C, it is common to use press hemming processing in the case where hemming coupling is performed between the outer panel 50 and the inner panel 60 by bending the hemming flange 51 provided at the edge portion 50*a* of the outer panel 50 in such a manner as to envelop the inner flange 61 provided at the edge portion 60*a* of the inner panel 60. However, press hemming processing requires a relatively expensive hydraulic press molding device and a processing device as a dedicated facility, so the cost of processing may increase.

Thus, in the present embodiment of the disclosure, the roller hemming processing method is used. However, with a view to facilitating the understanding of the disclosure, the possibilities peculiar to the case where hemming coupling is performed in the vehicular sun roof 40 and the possibilities in the case where hemming coupling as shown in FIG. 2C is performed through the use of the roller 110 (see FIG. 10B) according to the related art, which has only the processing surface 114 parallel to the axis SL, will be described prior to the description of the roller hemming processing method according to the present embodiment of the disclosure.

Figure 10A:
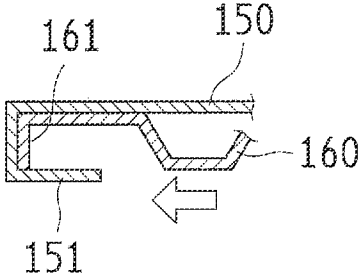
FIG. 10A RELATED ART
FIG. 10A is a view schematically illustrating the possibilities in a roller hemming processing method according to the related art and a roller hemming processing device according to the related art.

In roller hemming processing, as shown in FIG. 10A, it is common to perform hemming coupling between the outer panel 150 and the inner panel 160 by rolling the processing surface 114 while pressing this processing surface against the hemming flange 151 after inserting the edge portion of the inner panel 160 into the hemming flange 151 bent into the shape of a hook (folded back by 180°), as indicated by the blank arrow. However, in the vehicular sun roof 40, as described above, the outer panel 50 is stacked on the inner panel 60 (see FIG. 2B) in such a manner as to insert the rectangular cylinder-like flanges 51, 52, 53 and 54 into the inner sides of the rectangular cylinder-like flanges 61, 62, 63 and 64 respectively, so it is difficult to insert the edge portion 60*a* of the inner panel 60 into the hemming flange 51 bent into the shape of a hook. Therefore, the hemming flange 51 provided at the edge portion 50*a* of the outer panel 50 must be subjected to hemming processing from a state where there is no trigger for bending.

Figure 10B:
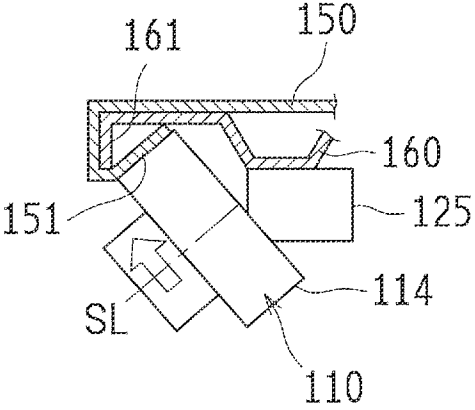
FIG. 10B RELATED ART
FIG. 10B is a view schematically illustrating the possibilities in the roller hemming processing method according to the related art and the roller hemming processing device according to the related art.

Besides, a state where the inner flange 161 provided at the edge portion of the inner panel 160 is inserted in the hemming flange 151 bent into the shape of a hook is assumed to have been created. However, when an attempt is made to mold a space enveloping the inner flange 161 by the processing surface 114 parallel to the axis SL of the roller 110, the processing surface 114 must be diagonally pressed against the hemming flange 151 bent back toward the inner flange 161 side at a right angle, as shown in FIG. 10B. In other words, the roller 110 must be in such a state that the axis SL thereof is inclined with respect to the outer panel 150, so there is also a possibility of interference between the receiving pedestal 125 for the inner panel 160 and the roller 110.

Figure 10C:
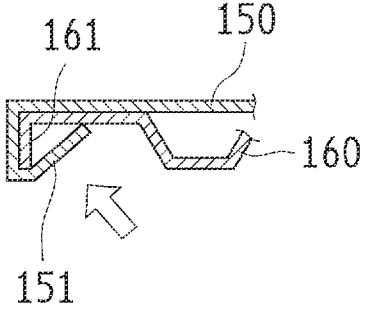
FIG. 10C RELATED ART
FIG. 10C is a view schematically illustrating the possibilities in the roller hemming processing method according to the related art and the roller hemming processing device according to the related art.

Furthermore, when an attempt is made to process the hemming flange 151 folded back toward the inner flange 161 side at a right angle just once through the pressing and rolling of the processing surface 114 (see the blank arrow in FIG. 10C), the leading end of the hemming flange 151 and the inner panel 160 interfere with each other as shown in FIG. 10C, so it may become difficult to mold the hem portion (the leading end portion that is in close contact with the inner panel 160).

Thus, in the roller hemming processing method according to the present embodiment of the disclosure, the first processing surface 14, the second processing surface 15, the third processing surface 16, the fourth processing surface 17 and the fifth processing surface 18, which are different from one another in angle of inclination and direction of inclination with respect to the axis SL of the roller 10, are selectively used in accordance with the stage of processing. In concrete terms, the roller hemming processing method according to the present embodiment of the disclosure includes the following first to fourth processes.

(1) In the first process, the edge portion 50*a* of the outer panel 50 is bound from above with the outer panel 50 stacked on the inner panel 60 such that the hemming flange 51 and the inner flange 61 overlap with each other on the roof font side and the roof rear side, and the outer panel 50 and the inner panel 60 are fixed to each other such that the region of the hemming flange 51 that overlaps with the inner flange 61 is bound from the roof front side.

(2) In the second process, the selected processing surfaces other than the second processing surface 15, namely, the third processing surface 16, the fifth processing surface 18 and the fourth processing surface 17 are used in a stepwise manner such that the angle of inclination with respect to the axis SL of the roller 10 decreases. Thus, a pre-processed portion 70 that is obtained by bending a region 51*a* of the hemming flange 51 that protrudes below the inner flange 61 toward the roof rear side in such a manner as to substantially form a right angle with the inner flange 61 is molded (see FIGS. 8A to 8C).

Figure 8A:
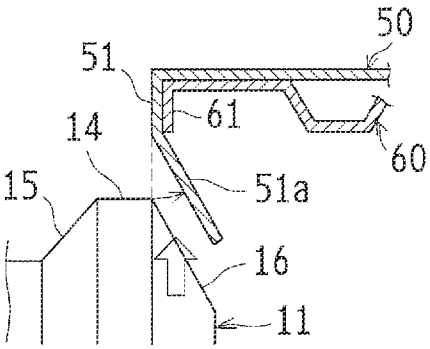
FIG. 8A is a view schematically illustrating a roller hemming processing method.
Figure 8B:
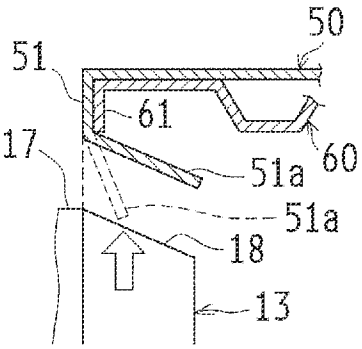
FIG. 8B is a view schematically illustrating the roller hemming processing method.
Figure 8C:
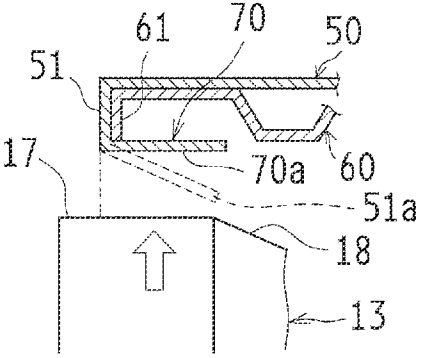
FIG. 8C is a view schematically illustrating the roller hemming processing method.
Figure 8D:
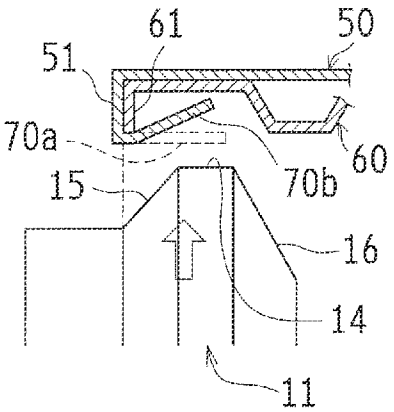
FIG. 8D is a view schematically illustrating the roller hemming processing method.

(3) In the third process, a region 70*a* of the pre-processed portion 70 that protrudes more toward the roof rear side than the inner flange 61 is inclined diagonally upward (toward the inner panel 60 side) within such a range as not to come into contact with the inner panel 60, through the use of the second processing surface 15 pressed by a first pressing amount (see FIG. 8D).

Figure 8E:
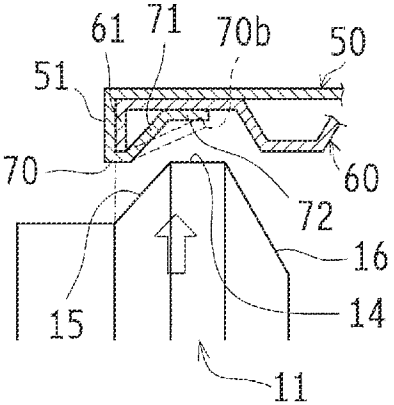
FIG. 8E is a view schematically illustrating the roller hemming processing method.

(4) In the fourth process, a region 70*b* of the pre-processed portion 70 that is inclined diagonally upward is molded into an inclined wall portion 71 that is inclined diagonally upward at 49° (a predetermined angle) and has an upper end in contact with the inner panel 60, and a hem portion 72 that extends toward the roof rear side from an upper end of the inclined wall portion 71 and that is in close contact with the inner panel 60, through the simultaneous use of the first processing surface 14 and the second processing surface 15, which are pressed by a second pressing amount that is larger than the first pressing amount (see FIG. 8E).

The respective processes will be described hereinafter in detail.

(1) First Process

First of all, after the first lower die 25 and the second lower die 26, which correspond to the sun roof 40 to be processed, are attached to the turning mechanism portion 27 through the use of the robot arm 31, the turning mechanism portion 27 is turned in accordance with the gradient of the sun roof 40. Subsequently, the inner panel 60 is placed on the first lower die 25 and the second lower die 26. Subsequently, the outer panel 50 is stacked on the inner panel 60 while inserting the rectangular cylinder-like flanges 51, 52, 53 and 54 into the inner sides of the rectangular cylinder-like flanges 61, 62, 63 and 64 respectively. Thus, as shown in FIG. 2B, the outer panel 50 is stacked on the inner panel 60 such that the hemming flange 51 and the inner flange 61 overlap with each other on the roof front side and the roof rear side.

In this state, positioning is carried out by the positioning pins 28, and the outer panel 50 and the inner panel 60 are integrally pinned down by the clamp units 29 at edge portions that define front and lateral ends of the opening portion 55 of the outer panel 50. Subsequently, the upper die 21 corresponding to the sun roof 40 to be processed is placed on the outer panel 50 with the positioning pins serving as references, through the use of the robot arm 31. Thus, the outer panel 50 and the inner panel 60 are sandwiched between the pad 22 and the second lower die 26. Also, the edge portion 50*a* of the outer panel 50 is bound from above by the hemming die 23, and the region of the hemming flange 51 that overlaps with the inner flange 61 is bound from the roof front side by the guide portion 24. In this state, the outer panel 50 and the inner panel 60 are integrally fixed to the fixing jig 20.

(2) Second Process

In the second process, as described above, the pre-processed portion 70 that is obtained by bending the region (hereinafter referred to also as a first region) 51*a* of the hemming flange 51 that protrudes below the inner flange 61 toward the roof rear side in such a manner as to form a right angle with the inner flange 61 is molded. In this case, a strain is generated when the bending amount in each bending cycle is large. Therefore, the bending amount in each bending cycle is set equal to or smaller than a predetermined threshold angle (e.g., 40°), and the pre-processed portion 70 is molded by repeating bending processing three times. More specifically, the hemming robot 30 is taught to mold the pre-processed portion 70 by using the selected processing surfaces other than the second processing surface 15, namely, the third processing surface 16, the fourth processing surface 17 (which can be replaced with the first processing surface 14) and the fifth processing surface 18 in a stepwise manner such that the angle of inclination with respect to the axis SL of the roller 10 decreases, that is, by using the third processing surface 16 that is inclined at 60° with respect to the axis SL, the fifth processing surface 18 that is inclined at 30° with respect to the axis SL, and the fourth processing surface 17 that is parallel to the axis SL (inclined at an angle of 0°) in this sequence.

First of all, the hemming robot 30 selects the third processing surface 16 as a processing surface and presses the third processing surface 16 against the first region 51*a* from below in such a posture that the axis SL is substantially parallel to the outer panel 50 as shown in FIG. 8A. In this case, as is the case with the aforementioned FIG. 7, the first processing surface 14 formed closer to the shaft portion 12 side than the third processing surface 16 is brought into contact with the lower end of the guide portion 24. Then, when the roller 10 is moved along the edge portion 50*a* of the outer panel 50 while holding the first processing surface 14 in contact with (in touch with) the lower end of the guide portion 24, the third processing surface 16 rolls while being pressed against the first region 51*a*, and the first region 51*a* is inclined toward the roof rear side at 30° with the inner flange 61 serving as a core bar.

Subsequently, the hemming robot 30 selects the fifth processing surface 18 as a processing surface, inverts the roller 10 by rotating the leading end portion 31*a* of the robot arm 31 by 180°, and presses the fifth processing surface 18 against the first region 51*a* inclined at 30° from below in such a posture that the axis SL is substantially parallel to the outer panel 50 as shown in FIG. 8B. In this case, as is the case with the aforementioned FIG. 7, the fourth processing surface 17 formed closer to the shaft portion 12 side than the fifth processing surface 18 is brought into contact with the lower end of the guide portion 24. Then, when the roller 10 is moved along the edge portion 50*a* of the outer panel 50 while holding the fourth processing surface 17 in contact with the lower end of the guide portion 24, the fifth processing surface 18 rolls while being pressed against the first region 51*a*, and the first region 51*a* is inclined toward the roof rear side at 60° with the inner flange 61 serving as a core bar.

Subsequently, the hemming robot 30 selects the fourth processing surface 17 as a processing surface and presses a leading end portion of the fourth processing surface 17 against the first region 51*a* inclined at 60° from below in such a posture that the axis SL is substantially parallel to the outer panel 50 as shown in FIG. 8C. In this case, a base end portion (a region close to the shaft portion 12) of the fourth processing surface 17 is brought into contact with the lower end of the guide portion 24. Then, when the roller 10 is moved along the edge portion 50*a* of the outer panel 50 while holding the base end portion of the fourth processing surface 17 in contact with the lower end of the guide portion 24, the fourth processing surface 17 rolls while being pressed against the first region 51*a*, and the first region 51*a* is inclined toward the roof rear side at 90° with the inner flange 61 serving as a core bar. Thus, the pre-processed portion 70 is molded.

As described hitherto, in the second process, the pre-processed portion 70 is molded by setting the bending amount in each bending cycle to 30° and repeating bending processing three times. Thus, a strain can be restrained from being generated when the bending amount in each bending cycle is large. Besides, the region of the hemming flange 51 that overlaps with the inner flange 61 is bound from the roof front side by the guide portion 24. Thus, the hemming flange 51 can be restrained from swelling toward the roof front side in bending the first region 51*a*. Moreover, the third processing surface 16 (or the fifth processing surface 18 or the fourth processing surface 17) is rolled while holding the first processing surface 14 (or the fourth processing surface 17) against the lower end of the guide portion 24. Thus, the hemming flange 51 can be accurately bent along the teaching locus from a state where there is no trigger for bending.

(3) Third Process

In the third process, as described above, the region (hereinafter referred to also as a second region) 70*a* of the pre-processed portion 70 that protrudes more toward the roof rear side than the inner flange 61 is inclined diagonally upward (in such a manner as to extend upward as the distance to the roof rear side decreases) through the use of the second processing surface 15. It should be noted herein that when the region 70*a* is inclined at once through the use of the second processing surface 15 that is inclined at 49° with respect to the axis SL, the bending amount in each bending cycle exceeds 40°. Therefore, a strain is generated, and the leading end of the pre-processed portion 70 and the inner panel 60 interfere with each other. Accordingly, in the third process, only preliminary bending processing is carried out in preparation for the fourth process.

More specifically, the hemming robot 30 selects the second processing surface 15 as a processing surface, inverts the roller 10 by rotating the leading end portion 31*a* of the robot arm 31 by 180°, presses the second processing surface 15 against the second region 70*a* from below by the first pressing amount in such a posture that the axis SL is substantially parallel to the outer panel 50, as shown in FIG. 8D. This "first pressing amount" is set to a value at which the second region 70*a* is inclined diagonally upward within such a range as not to come into contact with the inner panel 60, more concretely, to a value at which the second region 70*a* is inclined diagonally upward at 30°. Then, when the roller 10 is moved along the edge portion 50*a* of the outer panel 50, the second processing surface 15 rolls while being pressed against the second region 70*a* by the first pressing amount, and the second region 70*a* is inclined diagonally upward at 30° with the inner flange 61 serving as a core bar. Incidentally, the second region 70*a* inclined diagonally upward at 30° will be referred to hereinafter as a third region 70*b*.

(4) Fourth Process

In the fourth process, as described above, the third region 70*b* is molded into the inclined wall portion 71 that is inclined diagonally upward at 49° and that has an upper end in contact with the inner panel 60, and the hem portion 72 that extends toward the roof rear side from the upper end of the inclined wall portion 71 to be in close contact with the inner panel 60. The hemming robot 30 is taught to select the first processing surface 14 and the second processing surface 15 as processing surfaces, and simultaneously press the first processing surface 14 and the second processing surface 15 against the third region 70*b* from below by the second pressing amount that is larger than the first pressing amount, in such a posture that the axis SL is substantially parallel to the outer panel 50, as shown in FIG. 8E. Then, when the roller 10 is moved along the edge portion 50*a* of the outer panel 50, the second processing surface 15 rolls while being pressed against the third region 70*b*, and a base end portion of the third region 70*b* inclined diagonally upward at 30°, and the inclined wall portion 71 that is inclined diagonally upward at 49° and that has the upper end in contact with the inner panel 60 are molded, with the inner flange 61 serving as a core bar. At the same time, a leading end portion of the third region 70*b* inclined diagonally upward at 30° is sandwiched between the edge portion 50*a* of the outer panel 50 kept from moving upward by the hemming die 23 (more precisely, the edge portion 50*a* of the inner panel 60) and the first processing surface 14, and the hem portion 72 that extends toward the roof rear side from the upper end of the inclined wall portion 71 and that is in close contact with the inner panel 60 is molded.

The inclined wall portion 71 thus molded is substantially in a state where the edge portion 50*a* of the outer panel 50 is folded back beyond 180°. However, in the roller hemming processing method according to the present embodiment of the disclosure and the roller hemming processing device according to the present embodiment of the disclosure, the second processing surface 15 as a tapered surface that narrows toward the base end side (the shaft portion 12 side) of the roller 10 is used. Thus, unlike the case shown in FIG. 10B, this inclined wall portion 71 can be molded while maintaining such a posture that the axis SL is substantially parallel to the outer panel 50. Accordingly, the first lower die 25, which receives the inner panel 60, and the roller 10 can be restrained from interfering with each other.

Moreover, as described above, the protrusion length of the third processing surface 16 from the first processing surface 14 is relatively short. Thus, the first lower die 25, which receives the inner panel 60, and the roller 10 can be more effectively restrained from interfering with each other in the fourth process.

Incidentally, unlike the second process in which the hemming flange 51 is subjected to bending processing from the state where there is no trigger for bending, the first processing surface 14 and the second processing surface 15 can be rolled with somewhat high accuracy along the teaching locus, even if the roller 10 is not moved while being held in contact with the lower end of the guide portion 24, in the third process in which preliminary bending processing is carried out and the fourth process in which finishing is carried out.

Other Embodiments

The disclosure is not limited to the aforementioned embodiment thereof but can be carried out in various other modes without departing from the spirit or main features thereof.

Figure 9:
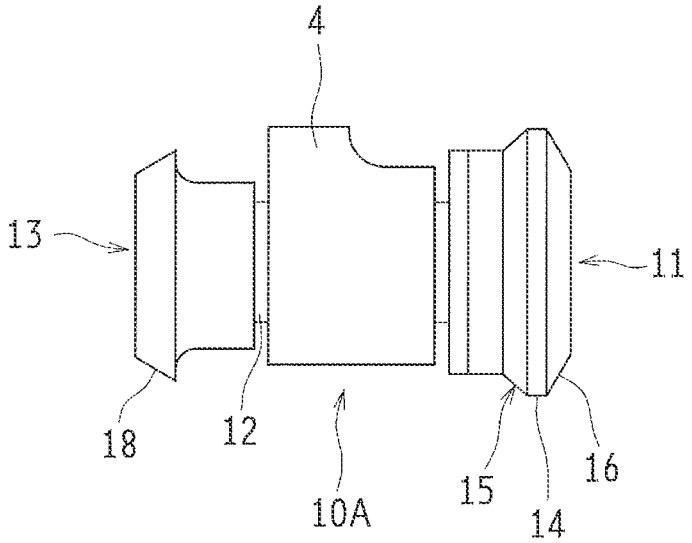
FIG. 9 is a view schematically showing a roller according to another embodiment of the disclosure.

In the aforementioned embodiment of the disclosure, the roller 10 having the first processing surface 14, the second processing surface 15, the third processing surface 16, the fourth processing surface 17 and the fifth processing surface 18 is used, but the disclosure is not limited thereto as long as the roller 10 has the first processing surface 14, the second processing surface 15, and the two or more tapered processing surfaces 16 and 18 that are inclined at different angles. For example, as shown in FIG. 9, a roller 10A that dispenses with the fourth processing surface 17 may be used. In this case, the first processing surface 14 may be used instead of the fourth processing surface 17, in molding the pre-processed portion 70 from the first region 51*a* inclined at 60° in the second process.

Besides, in the aforementioned embodiment of the disclosure, the third processing surface 16 is formed on the first roller portion 11, and the fifth processing surface 18 is formed on the second roller portion 13, but the disclosure is not limited thereto as long as the first lower die 25 and the roller 10 do not interfere with each other in the fourth process. For example, the third processing surface 16 may be formed on a leading end side of the fourth processing surface 17, and the fifth processing surface 18 may be formed on a leading end side of the first processing surface 14.

Furthermore, in the aforementioned embodiment of the disclosure, the second processing surface 15 is formed in such a manner as to be inclined at 49° with respect to the axis SL, but the disclosure is not limited thereto. The second processing surface 15 may be inclined at an appropriate angle in accordance with the finished shape of the vehicular sun roof 40.

Besides, in the aforementioned embodiment of the disclosure, the pre-processed portion 70 is molded by inclining the third processing surface 16 at 60° with respect to the axis SL, inclining the fifth processing surface 18 at 30° with respect to the axis SL, setting the bending amount in each bending cycle to 30° and repeating bending processing three times, but the disclosure is not limited thereto as long as the bending amount in each bending cycle is set equal to or smaller than the predetermined threshold angle (40° in the aforementioned embodiment of the disclosure). The pre-processed portion 70 may be molded by repeating bending processing four or more times. For example, the pre-processed portion 70 may be molded by inclining the third processing surface 16 at 67.5° with respect to the axis SL, inclining the fifth processing surface 18 at 22.5° with respect to the axis SL, further providing a sixth processing surface (not shown) as a tapered surface that is inclined at 45° with respect to the axis SL in such a manner as to narrow toward a leading end side from the fifth processing surface 18, and repeating bending processing four times with the bending amount in each bending cycle set to 22.5° in the sequence of the third processing surface 16, the sixth processing surface, the fifth processing surface 18 and the fourth processing surface 17.

Furthermore, in the aforementioned embodiment of the disclosure, the processing surface is pressed against the hemming flange 51 from below with the outer panel 50 stacked on the inner panel 60, but the disclosure is not limited thereto. For example, the processing surface may be pressed against the hemming flange 51 from above with the inner panel 60 stacked on the outer panel 50.

As described hitherto, the above-mentioned embodiment of the disclosure is nothing more than a mere exemplification in every respect and should not be interpreted in a restrictive manner. Furthermore, all the modifications and alterations pertaining to a scope equivalent to the claims fall within the scope of the disclosure.

According to the disclosure, hemming coupling can be performed between one panel and the other panel by bending a flange provided on one panel in such a manner as to envelop a flange provided on the other panel even from a state where there is no trigger for bending, while reducing the cost of processing. Therefore, it is quite useful to apply the disclosure to a roller hemming processing method and a roller hemming processing device.

What is claimed is:

1. A roller hemming processing method for bending a first flange provided at an edge portion of a first panel in such a manner as to envelop a second flange provided at an edge portion of a second panel stacked on the first panel and having a shorter length than the first flange, by rolling processing surfaces of a roller portion pressed against the first flange along the first flange, through use of a roller that is constituted of the roller portion and a shaft portion parallel to an axis of the roller, comprising:

preparing a roller hemming processing device that has a plurality of processing surfaces including at least a first processing surface parallel to the axis of the roller, a second processing surface that is inclined from the first processing surface toward a side of the shaft portion at a predetermined angle with respect to the axis of the roller, and two or more tapered processing surfaces that are inclined toward a leading end side of the roller at different angles with respect to the axis of the roller respectively, and that rolls the respective processing surfaces while pressing the respective processing surfaces against the first flange in such a posture that the axis of the roller is parallel to the first panel, and fixing the second panel to the first panel stacked on the second panel such that the first flange and the second flange overlap with each other, as a first process;

pressing a plurality of selected processing surfaces other than the second processing surface against a region of the first flange that protrudes from the second flange in a stepwise manner such that an angle of inclination with respect to the axis of the roller decreases, and molding a pre-processed portion that is obtained by bending the region toward a side of the second flange in such a manner as to form a right angle with the second flange, as a second process;

pressing the second processing surface against the pre-processed portion, and inclining the pre-processed portion toward a side of the second panel within such a range as not to come into contact with the second panel, as a third process; and simultaneously pressing the first processing surface and the second processing surface against the inclined pre-processed portion, and molding the inclined pre-processed portion into an inclined wall portion that is inclined at the predetermined angle and that has a leading end abutting on the second panel, and a hem portion that extends from a leading end portion of the inclined wall portion and that is in close contact with the second panel, as a fourth process.

2. The roller hemming processing method according to claim 1, wherein a first pressing amount by which the second processing surface is pressed against the pre-processed portion in the third process is smaller than a second pressing amount by which the first processing surface and the second processing surface are pressed against the inclined pre-processed portion in the fourth process.

3. The roller hemming processing method according to claim 1, wherein the first panel is an outer panel of a vehicular sun roof in which an opening portion is formed, the second panel is an inner panel of the vehicular sun roof, and the first flange and the second flange are provided at edge portions that define the opening portion, respectively.

4. A roller hemming processing device that bends a first flange provided at an edge portion of a first panel in such a manner to envelop a second flange provided at an edge portion of a second panel stacked on the first panel and having a shorter length than the first flange, by rolling processing surfaces of a roller portion pressed against the first flange along the first flange, comprising:

a fixing portion that is configured to fix the second panel to the first panel stacked on the second panel such that the first flange and the second flange overlap with each other;

a roller that is constituted of the roller portion and a shaft portion parallel to an axis of the roller, and that has a plurality of processing surfaces including at least a first processing surface parallel to the axis of the roller, a second processing surface that is inclined from the first processing surface toward a side of the shaft portion at a predetermined angle with respect to the axis of the roller, and two or more tapered processing surfaces that are inclined toward a leading end side of the roller at different angles with respect to the axis of the roller respectively, as the processing surfaces; and a moving portion that is configured to select a processing surface for use from the plurality of the processing surfaces, and move the roller while pressing the selected processing surface against the first flange in such a posture that the axis of the roller is parallel to the first panel, wherein the moving portion is configured to press a plurality of selected processing surfaces other than the second processing surface against a region of the first flange that protrudes from the second flange in a stepwise manner such that an angle of inclination with respect to the axis of the roller decreases, in molding a pre-processed portion that is obtained by bending the region toward a side of the second flange in such a manner as to form a right angle with the second flange, press the second processing surface against the pre-processed portion, in inclining the pre-processed portion toward a side of the second panel within such a range as not to come into contact with the second panel, and simultaneously press the first processing surface and the second processing surface against the inclined pre-processed portion, in molding the inclined pre-processed portion into an inclined wall portion that is inclined at the predetermined angle and that has a leading end abutting on the second panel, and a hem portion that extends from a leading end portion of the inclined wall portion and that is in close contact with the second panel.

5. The roller hemming processing device according to claim 4, wherein a first pressing amount by which the second processing surface is pressed against the pre-processed portion in inclining the pre-processed portion toward the side of the second panel is set smaller than a second pressing amount by which the first processing surface and the second processing surface are pressed against the inclined pre-processed portion in molding the inclined pre-processed portion into the inclined wall portion and the hem portion.

6. The roller hemming processing device according to claim 4, wherein the fixing portion has a guide portion that binds a region of the first flange that overlaps with the second flange from an opposite side of the second flange, and the moving portion is configured to move the roller while holding the roller in contact with the guide portion in molding the pre-processed portion.

7. The roller hemming processing device according to claim 4, wherein the roller has a first roller portion that is provided on one side of the shaft portion, and a second roller portion that is provided on another side of the shaft portion, the first processing surface, the second processing surface, and a third processing surface as one of the tapered processing surfaces, which is inclined from the first processing surface toward a leading end side at a first angle with respect to the axis of the roller, are formed on the first roller portion, whereas a fourth processing surface parallel to the axis of the roller and a fifth processing surface as one of the tapered processing surfaces, which is inclined from the fourth processing surface toward the leading end side at a second angle with respect to the axis of the roller, are formed on the second roller portion, and the first angle is set larger than the second angle.

* * * * *